United States Patent [19]

Ficke

[11] Patent Number: 4,766,915

[45] Date of Patent: Aug. 30, 1988

[54] FACIAL TREATMENT AND LOTION KIT

[75] Inventor: Geoff Ficke, Studio City, Calif.

[73] Assignee: Thermagene Limited, Geneva, Switzerland

[21] Appl. No.: 942,510

[22] Filed: Dec. 16, 1986

Related U.S. Application Data

[62] Division of Ser. No. 641,711, Aug. 17, 1984, Pat. No. 4,655,232.

[51] Int. Cl.[4] ..... A45D 40/00

[52] U.S. Cl. ..... 132/79 F; 206/210; 206/581

[58] Field of Search ..... 132/79 R, 79 A, 79 F, 132/82 D, 82 R; 128/399; 206/210, 229, 581

[56] References Cited

U.S. PATENT DOCUMENTS

| | | | |
|---|---|---|---|
| 1,847,572 | 3/1932 | Rich | 132/79 F |
| 1,962,760 | 6/1934 | Burk | 206/210 |
| 2,209,781 | 7/1940 | Lewis | 206/581 X |
| 4,533,051 | 8/1985 | Fleming | 206/581 X |

FOREIGN PATENT DOCUMENTS

| | | | |
|---|---|---|---|
| 2420316 | 11/1979 | France | 132/79 R |

*Primary Examiner*—Robert P. Swiatek

*Attorney, Agent, or Firm*—Abelman Frayne Rezac & Schwab

[57] ABSTRACT

A person's skin has its pores opened and treated with a non-alcoholic toner, and has subcutaneous blood circulation locally stimulated preparatory to an application to the skin of a lotion preparation massaged onto the skin and into the pores with an electrically inactive heated disk at a beginning temperature of from approximately 109° F. to approximately 111° F., where the heated disk maintains a temperature of over 106° F. during the approximate three and one-half minute treatment. The pores may be cleaned and opened by a cleansing treatment in one aspect utilizing the heated disk having greater than 106° F. temperature. A kit maintains various treatment lotions and liquids at ambient temperatures in an integral container along with the heated or heatable disk and its electrical heating pad.

4 Claims, 2 Drawing Sheets

FACIAL TREATMENT AND LOTION KIT

This is a division of application Ser. No. 641,711 filed on Aug. 17, 1984 and now U.S. Pat. No. 4,655,232.

BACKGROUND OF THE INVENTION

1. FIELD OF THE INVENTION:

The present invention relates to the art of facial treatment by lotion preparations, and more particularly to the massaging of particular lotion preparations into a person's skin, and for implements and a kit therefor.

2. DESCRIPTION OF THE PRIOR ART:

In the past, it has been known to treat a person's skin with lotion preparation employing electrically heated elements, such as heating irons either in the form of handles or having handles attached to them. Such skin treatment apparatuses, and the methods of applying lotion preparations utilizing such apparatuses have had distinct advantages in providing a skin massaging implement with a temperature elevated in relation to the skin being treated. Such raised temperature of the handled massaging implement tends to raise the temperature of the skin being treated so that the skin's pores will tend to open, and receive the lotion preparation being massaged or worked into the skin.

Some such skin treatment implements have been known to have particular and specific surfaces for contacting and interacting with the skin. For example, some such implements have been known to have absorbent skin-contacting surfaces for absorbing liquids and other matter from the skin, as seen in Engstrom, U.S. Pat. No. 1,573,693. Other implements have been described as having surfaces capable of absorbing and retaining certain amounts of the lotion preparation, which is to be transferred to the skin by contact of the implement with the skin, which has been pre-treated with steam or by some other step in order to facilitate the transfer from the pad to the skin, as seen, for example, in Haessley, U.S. Pat. No. 1,653,901. Other such implements are described as containing reservoirs on the handle for containing and evenly distributing the lotion preparations to the skin being treated, such as seen, for example, in Oppenheimer, U.S. Pat. No. 1,899,770.

In the past, such particular skin-contacting surfaces have been specified as being of particular material, such as, for example, "ruby glass" in Dorrance, U.S. Pat. No. 1,952,659, for special effects, such as, for example, bleaching.

Not uncommonly, such skin treatment arrangements have described a series of steps involving also a cooling of the skin in order to congeal or extenuate the positioning of the lotion preparations on the skin.

Also not infrequently, such skin treatment involves a preparation of alcohol based lotion preparations. While normally alcohol has a tendency to close pores, the skin treatment methods of the art will not infrequently use a pore-opening step which will obviate the pore-closing circumstance that may retard absorption by the skin, or at least the pores, of the lotion preparation.

It is desired, however, to have a method for skin treatment having relatively elevated skin temperatures which will not involve an electrically active heating element for raising the temperature of the skin being treated. It is also desired to have a skin treatment method where a heating element used to massage lotion preparations into pores of or onto the skin is safe from dilatoriously high temperatures. It is further desired to have a skin treatment method involving non-alcohol based lotion preparations. It is yet further desired to have a skin treatment method having lotion preparations worked into open pores of the skin by an electrically inactive heated element capable of maintaining sufficient heat for stimulating subcutaneous blood circulation and for keeping the pores relatively open, but not having dilatoriously excessive heat in the heating element. It is also desired to have a kit having ambient temperature lotion preparations and a heated element in a unitary, common container, in order to aid the use of desired skin treatment methods.

SUMMARY

In brief, in accordance with one aspect of the present invention, a method for treating human skin is described having the steps of heating an electrically inactive, substantially flat aluminum metal disk to a temperature of from approximately 109° F. to no more than approximately 115° F., while applying to the skin to be treated a cleansing lotion preparation. The cleansing lotion preparation is massaged into the skin using the electrically inactive, substantially flat aluminum metal disk by working the flat metal disk over the skin onto which the cleansing lotion preparation has been applied. The massaging or working of the lotion into the skin is completed in approximately three to three and one-half mintues, and the heatable disk or element maintains a temperature of approximately 106° F. or more during the working operation.

The residual cleansing lotion preparation is removed from the skin at ambient temperatures while the heating element is re-heated to a temperature from approximately 109° F. to approximately 115° F. The skin is treated with an application of a non-alcoholic skin toner, followed by an application, in one aspect of the invention, by a moisturizing lotion preparation. The moisturizing lotion preparation is then worked or massaged into the skin by working the heated disk or element over the skin onto which the moisturizing lotion preparation has been applied. The working or massaging step is completed in approximately three to three and one-half minutes, and the heating element maintains a temperature of approximately 106° F. or more during the working or massaging steps.

In another aspect of the method invention, a night cream lotion preparation is applied to the skin to be treated after the application of the non-alcoholic skin toner. The night cream preparation is then worked into the opened pores of the skin by a working or massaging of the skin having the night cream applied on it, using at commencement the heatable disk or element heated at a temperature of from approximately 109° F. to approximately 115° F. The working or massaging step is completed in approximately three to three and one-half mintues, and the heated disk maintains a temperature of approximately 106° F. or more during the working massaging steps.

A kit for maintaining the skin treating lotion preparations at ambient temperatures, and the heated or heatable skin massaging disk in a single, common container is described having spaced wells for holding jars of the individual lotion preparations to be applied in the method invention. A thermal heating pad or plate is provided within the same container having these spaced wells, the thermal pad being insulated by insulating material between it and the spaced wells. In the described embodiment, the thermal heating pad is further insulated from the wells by being spaced by air from the wells. The thermal pad is heated by electrical resistance, and controlled not to exceed 115° F. at any time. The thermal pad is recessed within the container so as to hold and to contain the substantially flat, and electrically inactive aluminum metal disk. The skin working and contacting surface of the metal disk is shaped in substantially the same and complemental shape of the thermal heating pad, so that the entire operative or working surface of the heatable disk when placed in the kit engages and comes into contact with the thermal pad.

The heatable disk is designed with a handle adapted to hold the substantially flat, and electrically inactive aluminum metal disk, and further is non-heat conducting and heat insulating in order (i) to maintain the heat on the disk's working surface, and (ii) to prevent the hand holding the handle from becoming hot or more warm than it otherwise would be in the ambient temperature.

Other novel features which are believed to be characteristic of the invention, both as to organization and method of operation, together with further objects and advantages thereof, will be better understood from the following description considered in connection with the accompanying drawing in which a preferred embodiment of the invention is illustrated by way of example. It is to be understood, however, that the drawings are for the purpose of illustration and description only, and are not intended as a definition of the limits of the invention.

DESCRIPTION OF THE PREFERRED EMBODIMENT

Figure 1:
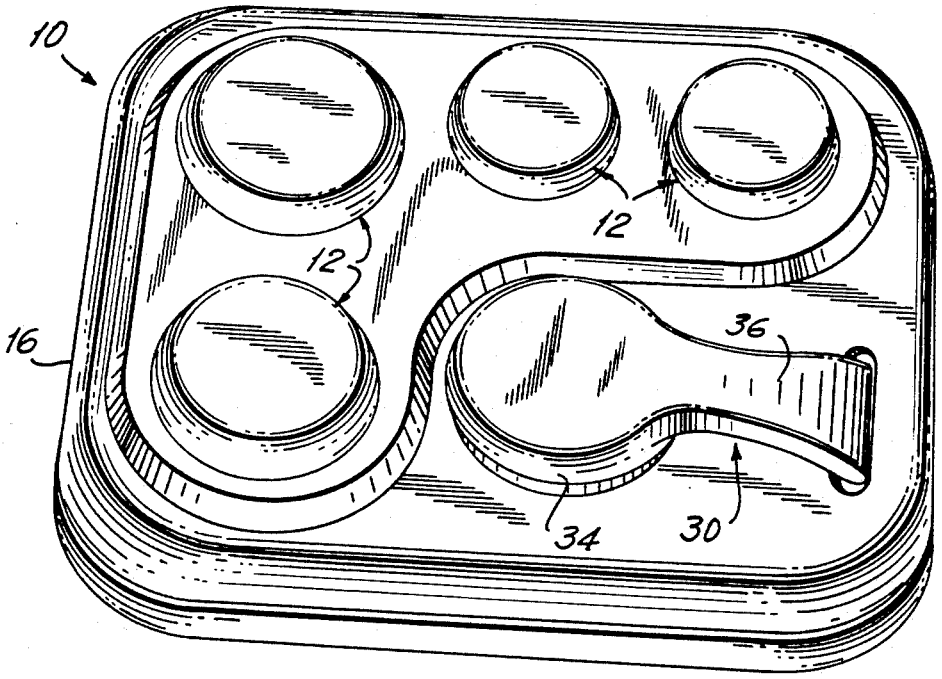
FIG. 1 is a perspective view of the preferred embodiment as assembled the kit of the present invention.

A kit 10 contains a plurality of lotion preparation containers or jars 12, reference being had initially to FIG. 1 of the drawings. The kit 10 also contains a heatable element or disk 30 which will be described in more detail below.

The kit 10 comprises a tray member 16 constructed of a heat insulating material 18. The tray 16 has formed therein spaced wells 24 adapted to receive containers for holding and keeping lotion preparations, such as jars 12. As shown, reference being had to FIGS. 1 and 2, the jars 12 are cylindrical in shape comprising a jar cap 20 and jar body 22. The jar caps 20 may be removed from the jar bodies 22 while the jar bodies 22 remain in their corresponding wells 24. The wells 24 depend from a surface 14 which is raised from the remaining top surface of the tray member 16 in order to further separate the jars 12 from a heatable element 30, for purposes explained in greater detail below.

Figure 2:
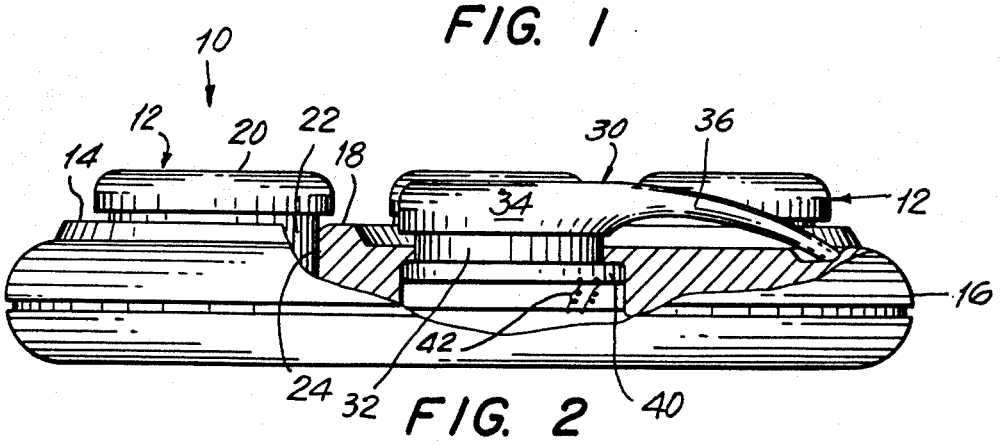
FIG. 2 is a side elevation of the preferred embodiment of the kit, assembled for use, of the invention of FIG. 1, having portions cut away for simplicity of illustration.
Figure 3:
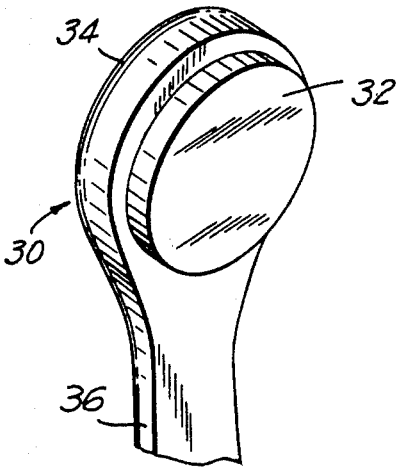
FIG. 3 is a perspective view of the heatable disk portion of the preferred embodiment of the invention of FIGS. 1 and 2.

A heated or heatable element 30, as seen more clearly in FIG. 3, but also in FIGS. 1 and 2 is comprised of a heat plate or thermal disk 32 having a substantially circular and flat surface adapted for contact with the skin to be treated. The thermal disk 32 is made of aluminum preferably, and has, relative to the rest of the heatable element 30, a substantially greater mass, for purposes as will be explained below.

The tray 16 also contains a thermal pad 40 positioned separated and thermally insulated from the jars 12 and their corresponding wells 24. The thermal pad 40 is heated by electrical resistance 44 through wire leads 42. The thermal pad 40 is adapted to be shaped so as to complement the surface of the thermal disk 32 so that the thermal disk 32 can be placed on top of the thermal pad 40 to be heated. The tray 16 has an opening forming a slight well above the thermal pad 40 for holding the thermal pad 40 and for receiving snugly and holding the thermal disk 32 in contact with the thermal pad 40 as desired.

The heatable element 30 further comprises a handle portion 36 and a disk holding portion 34, preferably in a unitary structure in order to enable a person to hold the thermal disk 32 without touching it. The handle 36 and disk holding portion 34 are preferably made of heat insulating material that is comparable to the heat insulating material 18 of the tray 16.

The thermal pad 40 is heated by a resistance heating element 44 having power supplied to it through wire leads 42 connecting the resistance heating element 44 to conventional alternating current power supply 50, such as the conventional power supplied in homes and offices. The alternating current is converted to a direct current by autotransformer 46 connected to the power supply 50 by leads 48 and to the heating element 44 by leads 42, reference being had to FIG. 4 of the drawings.

A temperature sensitive resistance switch 52 may be connected in series circuit with the resistor 44 and the autotransformer 46, in order to break the circuit of the leads 42 when the temperature of the thermal pad 40 reaches a preselected temperature, preferably approximately 112° F.

In operation, the kit is used in a manner to provide a convenient collection of the necessary implements and lotion preparations for treating the skin. The method will accomplish the objects of deeply penetrating certain lotion preparations into the pores of the skin and stimulating the subcutaneous blood circulation. In particular, it is expected that one of the jars 12 will contain a cleansing lotion, another of the jars 12 will contain a non-alcohol based herbal toner, a third of the jars will contain a thermal moisturizing cream, and the fourth jar 12 will contain a thermal night cream.

Initially, the alternating current power source 50 will be plugged into a conventional power supply, to heat the thermal pad 40, through the heating element 44, to a temperature of from approximately 112° F. to 115° F. The thermally sensitive resistor switch 52 will break the circuit of leads 42 when the thermal pad 40 reaches the temperature preselected.

The heatable element 30 is placed so that the thermal disk 32 is in heat conductive contact with the thermal pad 40. The heat conductive aluminum metal of disk 32 will be rapidly heated to a temperature comparable to the thermal pad 40, and in any event at least 111° F. The thermal disk 32 is comprised of sufficient metal mass so that it can hold a temperature of greater than 106° F. when it is removed from the thermal pad 40 and placed in the environment of the treated skin, which will be at approximately 98.6° F., for at least a period of three to three and one-half minutes.

Figure 4:
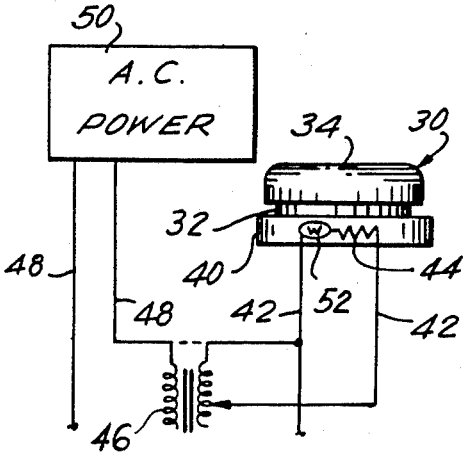
FIG. 4 is an electrical schematic of the preferred embodiment of the invention of FIG. 1.
Figure 5:
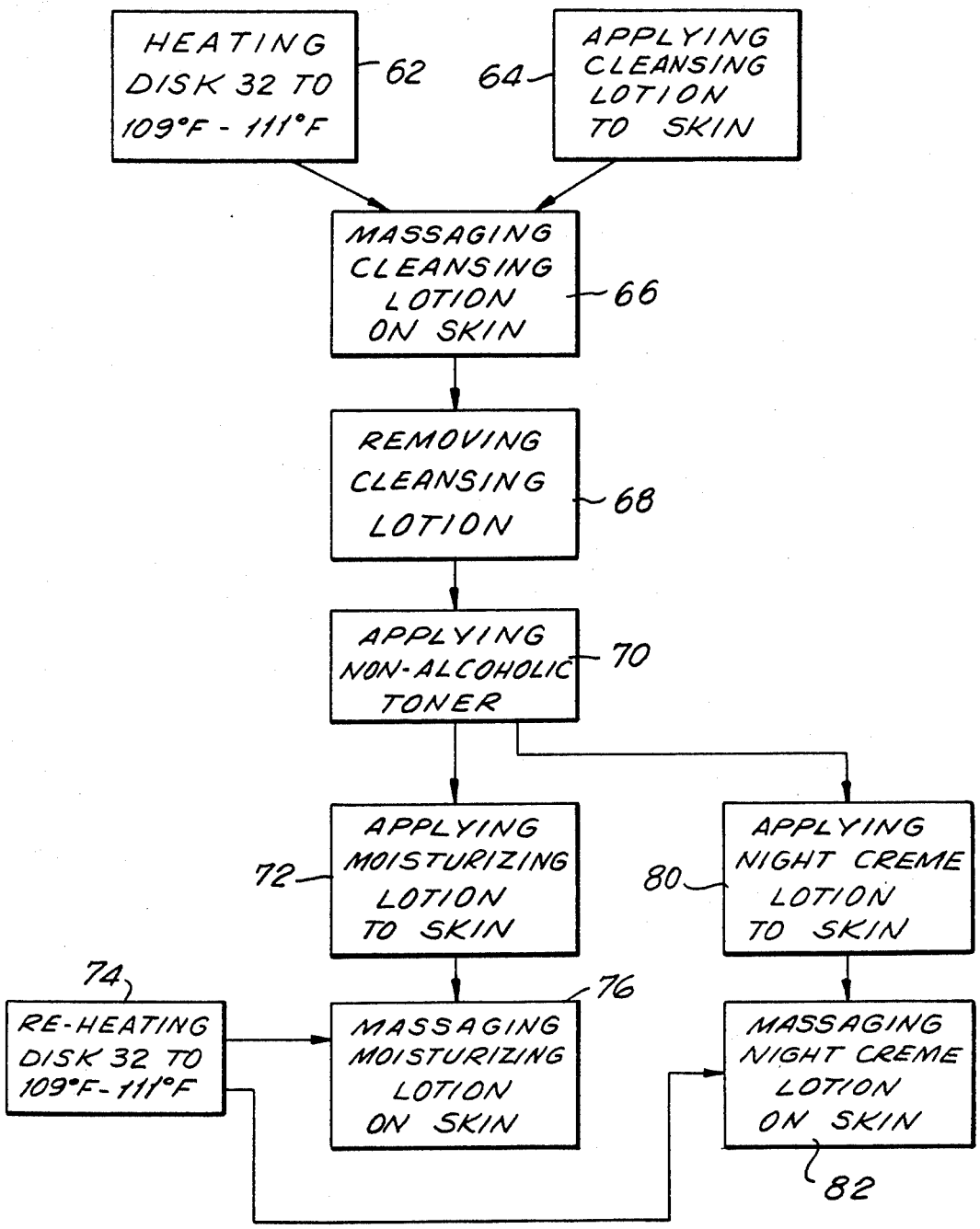
FIG. 5 is a block diagram of the preferred embodiment of the method of treating skin according to the present invention.

In the treatment of the skin, first the cleansing lotion is applied 64 to the skin to be treated, most usually the face, reference now being had to FIG. 4 of the drawings. The cleansing lotion may be applied by fingers of the hand in a conventional manner. While or before the cleansing lotion is being applied, the thermal pad 40 is plugged into conventional power supply 50, and the thermal disk 32 is placed into its seat in the kit 10 so that the aluminum metal of the thermal disk 32 is heated to between approximately 109° F. to approximately 111° F. It has been found that the thermal disk 32 may be heated to as much as 115° F. without becoming too hot for contact with the skin in the manner in connection with the method described below, but that the range of 109° F. to 111° F. is optimum for maintaining the heat in the disk 32, and remaining hot enough to accomplish the method of the present invention, while avoiding excessive and unnecessary heat on the skin.

The heatable element 30 is then grabbed by its handle 36, and the thermal disk 32 is placed in contact with the skin having the cleansing lotion applied. With temperature of the thermal disk 32 at approximately 109° F. upon initial contact with the skin, the subcutaneous blood adjacent the skin so contacted has the circulation stimulated by the action of the heat. In addition, the pores of the skin so contacted tend to open when in proximity to the heated thermal disk 32. The thermal disk 32 is then rubbed 66 on the skin so as to provide a massage to the skin. If the method is being used on the face, brisk circular motions should be used. If the method is being used on the neck, steady upward and outward motions should be used. In this manner, dead skin cells and residue are removed.

The cleansing lotion, therefore, is worked deeply into the skin's opened pores. In addition, the cleansing action is enhanced by the stimulation of the blood circulation in the subcutaneous region. The entire massaging of the skin with the thermal disk 32 should be accomplished in the range of from three to three and one-half minutes, and the temperature of the thermal disk itself will remain at or higher than 106° F. during this step.

The cleansing lotion is then removed 68 from the skin while the heating element 30 is replaced on top of the thermal pad 40 to be re-heated 74 to a temperature of approximately 109° F. to approximately 111° F. While the thermal disk 32 is thus re-heating, a non-alcohol based toner is applied 70 to the skin to give the skin a luster and to prepare the skin for the next step. It is important that the toner be non-alcohol based, in order to leave the pores of the skin in an open state. Conventional alcoholic toners would tend to close the pores of the skin, and deleteriously affect the remaining steps of the preferred method.

The next step in one aspect of the treatment invention is the application 72 of a moisturizing lotion to the skin. The thermal disk 32 should be re-heated 74 to its commencing temperature of approximately 109° F. or more, and it is then used then to massage 76 the moisturizing lotion on the skin and into the pores which have remained open by virtue of the use of a non-alcohol based toner. In addition, and similarly with the massaging in the cleansing lotion step 66, the temperature of the thermal disk 32 stimulates the subcutaneous blood circulation in the area where the moisturizing lotion has been applied, thus enhancing the beneficial effect of the moisturizing lotion being massaged 76 on the skin.

In yet another aspect of the method of treating the skin, the same steps of heating 62 the thermal disk 32 to approximately 109° F. or more, and of applying 64 cleansing lotion to the skin, followed by the massaging 66 of the cleansing lotion onto the skin and into the pores of the skin by the thermal disk 32, followed by the removal 68 of the cleansing lotion and the application 70 of a non-alcohol based toner are accomplished. After the massaging 60 in the cleansing step, the heating element 30 is replaced on the heating thermal pad 40 so that the thermal disk 32 is raised to approximately 109° F. or more, also in a manner similar to the preferred method. The succeeding step, however, consists of the application 80 of a night cream lotion preparation to the skin. The night creme lotion is massaged 82 onto the skin and into the pores thereof by the massage action of the thermal disk 32, in a manner similar to the massage 76 of the moisturizirg lotion on the skin in the preferred method. The beneficial effect of the night cream lotion on the skin and in the pores is enhanced by stimulation of the blood circulation in the subcutaneous region adjacent the skin being massaged because of the heat of the thermal disk 32. The massaging 82 of the night cream is accomplished in approximately three to three and one-half minutes, and the thermal disk 32 maintains a temperature of approximately 106° F. or more throughout this massaging step.

As may be seen from the foregoing detailed description of my preferred embodiments, a kit is provided so that the necessary cleansing lotions, toner, moisturizing lotion and night cream lotion preparations, as well as a heatable element 30 having a thermal disk 32 are maintained, contained and kept in a unitary, common kit. The heatable thermal disk 32 can be heated while remaining in its secure position within the kit 10 and yet the various lotions and cleanser preparations and toner will remain at ambient temperatures because of the insulating material 18 used in the kit 10. Furthermore, the heatable element 30 is stored or secured in a location having a elevation recessed from the surface 14 from which depend the wells 24 containing the jars 12. In this manner, the caps 20 of the jars 12 can be removed and replaced, and the lotions and preparations can be lifted by the fingers out of the jars 12, and the opportunity for the hand to accidentally knock the heatable element 30 off the surface and away from the kit is significantly reduced. The temperature of the thermal pad 40 is limited by a circuit breaking heat sensitive resistor switch 52, so that the danger of an exposed thermal pad 40 hurting a user is reduced.

A method of treating the skin is described which affords the user a convenient and safe way of applying heat to the face and neck and other skin areas without having an electrically active massaging unit or applicator. The heat is sufficient to produce a deep, penetrating facial cleansing and absorption of either the moisturizing lotion or of the night cream lotion, as the case may be, while stimulating the circulation of subcutaneous blood and smoothing superficial skin wrinkles. If the massaging steps are accomplished with brisk, circular motions, or on the neck and cheek in steady upward and outward motions, the cleansing step will not only clean, but remove dead skin cells and residue. A non-alcohol based toner will tone the skin and remove remaining traces of cleanser preparations, and prepare the skin for the moisturizing cream or night creme lotion preparation while not closing any of the pores in the skin. The massaging of the moisturizer lotion preparation in one aspect, and of the night cream lotion preparation in another aspect, using the electrically inactive but heated thermal disk 32 provides for significantly increased moisture retention or night, cream retention in the skin without using an electrical active applicator. All the while, the blood circulation of the subcutaneous region is stimulated. The result of the treatment described is skin with greater elasticity, glow, and blood circulation and the removal of wrinkled skin in a short time period.

The foregoing detailed description of my invention in a preferred embodiment, both as to apparatus and as to method, is illustrative of specific embodiments only. It is to be understood, however, that additional embodiments may be perceived by those skilled in the art. The embodiments described herein together with those additional embodiments are considered to be within the scope of the present invention.

I claim:

1. A kit comprising:

(a) an electrically inactive handle member comprising an electrically inactive substantially flat metal disk capable of absorbing and holding heat, and held by a handle portion having heat insulating characteristics and being substantially non-heat conducting;

(b) a plurality of lotion preparation containers containing lotion preparations;

(c) a tray member comprising:

(i) holding wells for holding a corresponding plurality of lotion preparation containers containing lotion preparations at ambient temperature;

(ii) a heating element having heating pad means and adapted to hold said electrically inactive substantially flat metal disk, for raising the temperature of said electrically inactive substantially flat metal disk while it is being held by said heating element, to temperature of from approximately 109° F. to approximately 115° F.; and, (iii) means for thermally insulating said heating element and said substantially flat metal disk from said holding wells and from said lotion preparation containers being held therein.

2. The kit of claim 1 wherein said electrically inactive substantially flat metal disk comprises a substantially flat metal surface adapted for contact with the skin.

3. The kit of claim 2 wherein said substantially flat metal surface is aluminum.

4. The kit of claim 1 wherein said electrically inactive substantially flat metal disk comprises that mass capable of maintaining a temperature greater than 106° F. for a period of three and one-half minutes in an ambient environment of 98.6° F. after said electrically inactive substantially flat metal disk is heated to a temperature of at least approximately 109° F.

* * * * *